US009586110B2

(12) United States Patent
Wortman et al.

(10) Patent No.: US 9,586,110 B2
(45) **Date of Patent: *Mar. 7, 2017**

(54) SYSTEM TO IMPROVE SWINGING MOTION

(71) Applicants: A. Alex Wortman, Ann Arbor, MI (US); Anton Wortman, Ann Arbor, MI (US)

(72) Inventors: A. Alex Wortman, Ann Arbor, MI (US); Anton Wortman, Ann Arbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/049,840

(22) Filed: Feb. 22, 2016

(65) Prior Publication Data

US 2016/0166896 A1 Jun. 16, 2016

Related U.S. Application Data

(63) Continuation-in-part of application No. 14/601,546, filed on Jan. 21, 2015, now Pat. No. 9,283,452.

(Continued)

(51) Int. Cl.

*A63B 57/00* (2015.01)
*A41D 13/00* (2006.01)

(Continued)

(52) U.S. Cl.

CPC ..... *A63B 57/00* (2013.01); *A41D 13/0015* (2013.01); *A63B 69/3623* (2013.01); *A41D 1/002* (2013.01); *A41D 1/04* (2013.01); *A41D 27/10* (2013.01); *A41D 2600/10* (2013.01); *A63B 2071/0625* (2013.01); *A63B 2071/0627* (2013.01); *A63B 2071/0655* (2013.01);

(Continued)

(58) Field of Classification Search

CPC .... A41B 1/00; A41B 1/02; A41B 1/08; A41B 1/18; A41D 13/00; A41D 13/0015; A41D 2600/00; A41D 2600/10; A41D 1/00; A41D 1/002; A41D 1/005; A41D 13/088; A63B 57/00; A63B 69/36; A63B 69/3641; A63B 69/3608; A63B 69/0057; A63B 69/0059

USPC ..... 2/69, 115, 113, 102, 243.1

See application file for complete search history.

(56) References Cited

U.S. PATENT DOCUMENTS 7,602,301 B1 * 10/2009 Stirling ..... A61B 5/1127 340/573.1
8,083,693 B1 * 12/2011 McKeon ..... A61B 5/103 600/587

(Continued)

*Primary Examiner* — Gloria Hale
(74) *Attorney, Agent, or Firm* — Brinks Gilson & Lione

(57) ABSTRACT

A shirt for improving a swinging motion of a user wearing the shirt includes front and rear panels each having corresponding top, bottom and generally opposing side edges, wherein the front and rear panels are adjoined to each other by the top and side edges, defining an interior space of the shirt. The front and rear panels include sleeve cutouts formed on each side edge adjacent the top edge, and a neck cutout formed on the top edges of the front and rear panels. At least one tubular sleeve is permanently joined to the front and rear panels of at least one of the sleeve cutouts, the tubular sleeve defining an inside area, the inside area being fluidly connected to the interior space of the shirt. A member is substantially adjacent to the sleeve cutout and the side edges of both the front and rear panels.

17 Claims, 9 Drawing Sheets

Related U.S. Application Data

(60) Provisional application No. 61/929,682, filed on Jan. 21, 2014, provisional application No. 61/938,789, filed on Feb. 12, 2014.

(51) Int. Cl.

| | |
|---|---|
| ***A63B 69/36*** | (2006.01) |
| *A41D 1/00* | (2006.01) |
| *A41D 1/04* | (2006.01) |
| *A63B 71/06* | (2006.01) |
| *A41D 27/10* | (2006.01) |

(52) U.S. Cl.

CPC ... *A63B 2071/0694* (2013.01); *A63B 2220/40* (2013.01); *A63B 2220/56* (2013.01); *A63B 2225/50* (2013.01)

(56) References Cited

U.S. PATENT DOCUMENTS

| | | | | |
|---|---|---|---|---|
| 2003/0170599 | A1* | 9/2003 | Hart | A63B 69/3608 434/252 |
| 2009/0047645 | A1* | 2/2009 | Dibenedetto | H04M 1/72563 434/258 |
| 2009/0048070 | A1* | 2/2009 | Vincent | A63B 24/0021 482/8 |
| 2009/0258719 | A1 | 10/2009 | Wortman | |
| 2012/0183939 | A1* | 7/2012 | Aragones | A63B 24/0006 434/247 |
| 2012/0268592 | A1* | 10/2012 | Aragones | G09B 19/0038 348/143 |
| 2013/0212505 | A1* | 8/2013 | Herold | G06F 3/04842 715/765 |

* cited by examiner

SYSTEM TO IMPROVE SWINGING MOTION

CROSS REFERENCE TO RELATED APPLICATION

This application is a continuation in part of U.S. patent application Ser. No. 14/601,546 filed on Jan. 21, 2015, which claimed the benefit of U.S. Provisional Application No. 61/929,682 filed on Jan. 21, 2014 and U.S. Provisional Application No. 61/938,789 filed on Feb. 12, 2014 all of which are herein incorporated by reference in their entirety.

BACKGROUND

1. Field of the Invention

The invention generally relates to sports training devices for improving a swinging motion of a user, especially a swinging motion relating to the sport of golf.

2. Description of Related Art

Golf, like other sports that require an arm swinging motion, is a sport that requires a significant amount of finesse. As a golfer swings at a golf ball, even the slightest variation of the golfer's swing can affect the distance and direction the golf ball travels. As it is well known, golfers spend significant amounts of time and resources to improve their swinging performance.

It has been observed that golfers, especially untrained golfers, when attempting to hit the golf ball, struggle to produce a proper and effective swing path. On the back swing, there is a tendency for untrained golfers to not make a suitable full shoulder turn. On the down swing, there is a tendency for untrained golfers to go "over-the-top." An "over-the-top" swing is a swing from the outside to the inside of a target line. Finally, there is a tendency for untrained golfers to not finish the full swing cycle by completely following the swing through.

Prior art solutions are generally limited to personal trainers or cumbersome training devices that are not suitable for everyday use. Some of these cumbersome devices are embarrassing to use in public, as they required the user to wear an apparatus that was readily noticeable as a training device. Additionally, because these prior art devices are not suitable for everyday use, golfers, especially untrained golfers, do not receive the constant feedback necessary to develop a proper golf swing.

SUMMARY

A shirt for improving a swinging motion of a user wearing the shirt includes front and rear panels each having corresponding top, bottom and generally opposing side edges, wherein the front and rear panels are adjoined to each other by the top and side edges, defining an interior space of the shirt. The front and rear panels include sleeve cutouts formed on each side edge and adjacent to the top edge. The shirt also includes a neck cutout formed on the top edges of the front and rear panels. At least one tubular sleeve is permanently attached to the front and rear panels of at least one of the sleeve cutouts, the tubular sleeve defining an inside area, the inside area being fluidly connected to the interior space of the shirt. A member is substantially adjacent to the sleeve cutout and the side edges of the front and/or rear panels. The member generally has a side that is substantially flat along a curvature that follows the length of the member.

Further, the member may also include an electronic device having a processor. The processor may be connected to one or more sensors for that provide information back to the processor. The processor can in turn calculate the swing motion of the user of the member based on information received from the sensors. These calculations could then be provided by the processor to an external device, such as a smart phone or computer, via a network access device that is also connected to the processor. In additional to sensing devices, the electronic device 60 may also have a physical feedback device configured to provide some form of feedback to the user of the member.

Further objects, features and advantages of this invention will become readily apparent to persons skilled in the art after a review of the following description, with reference to the drawings and claims that are appended to and form a part of this specification.

DETAILED DESCRIPTION

Figure 1:
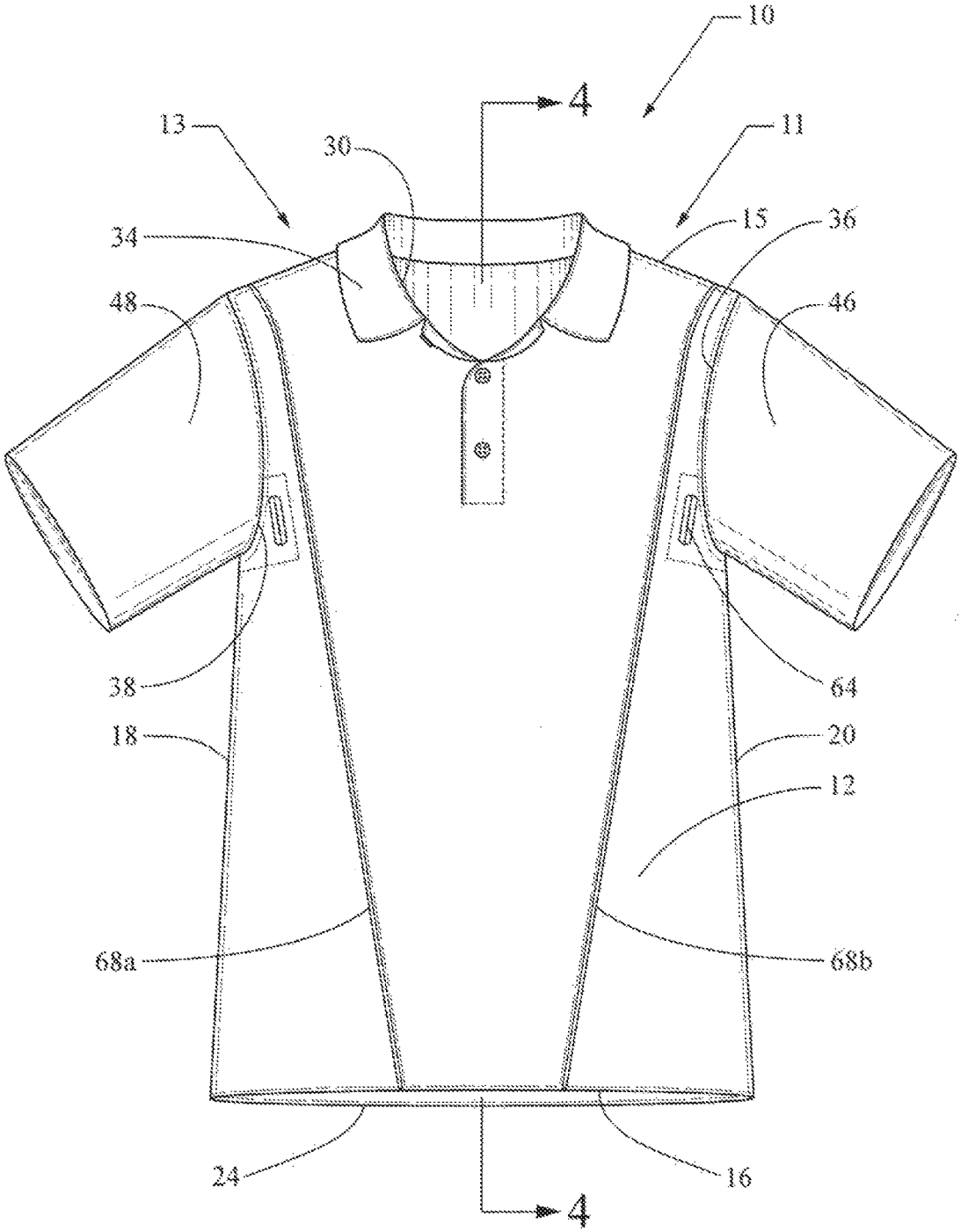
FIG. 1 illustrates a front view of a shirt for improving a swinging motion of a user wearing the shirt.
Figure 2:
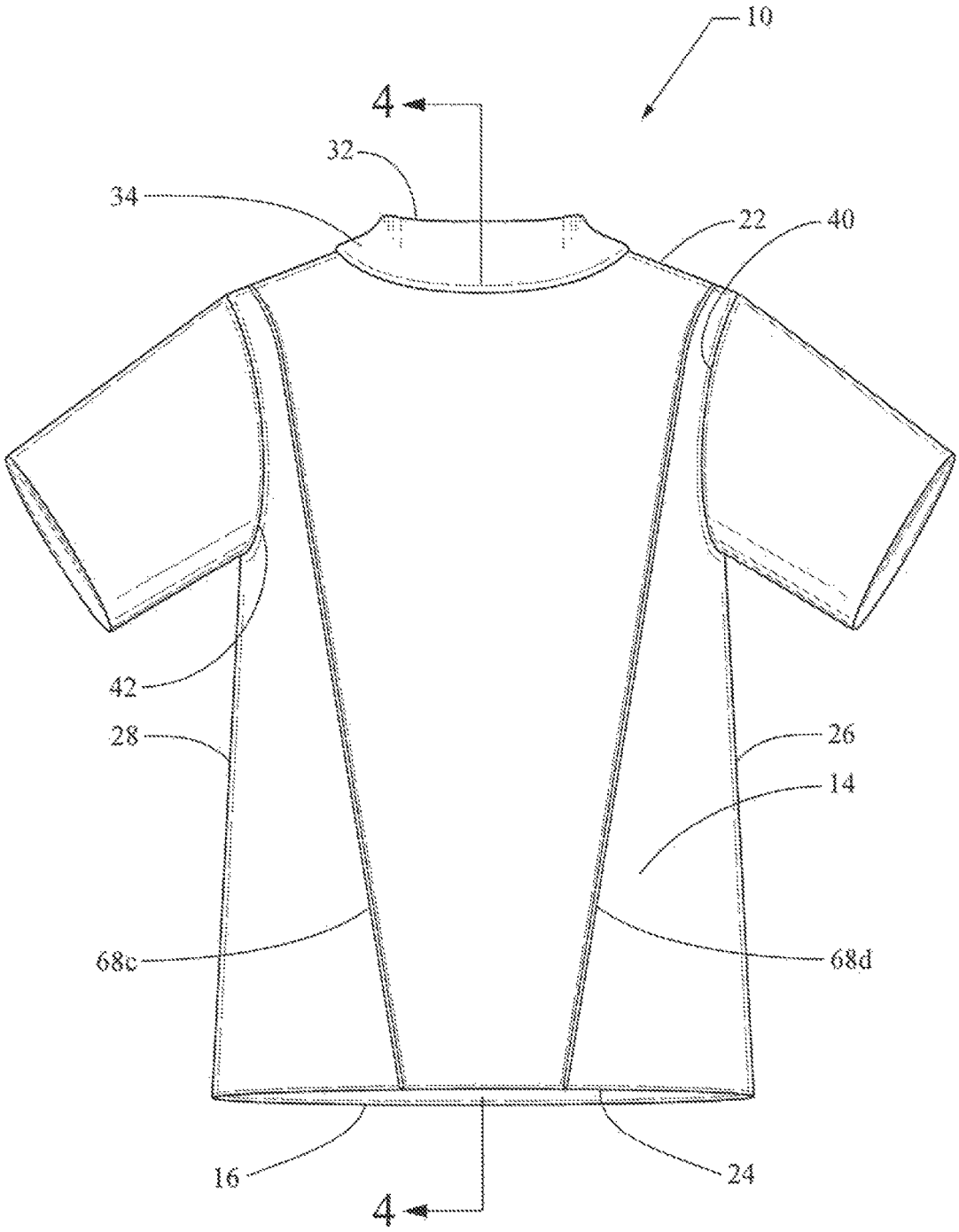
FIG. 2 illustrates a back view of the shirt of FIG. 1.
Figure 3:
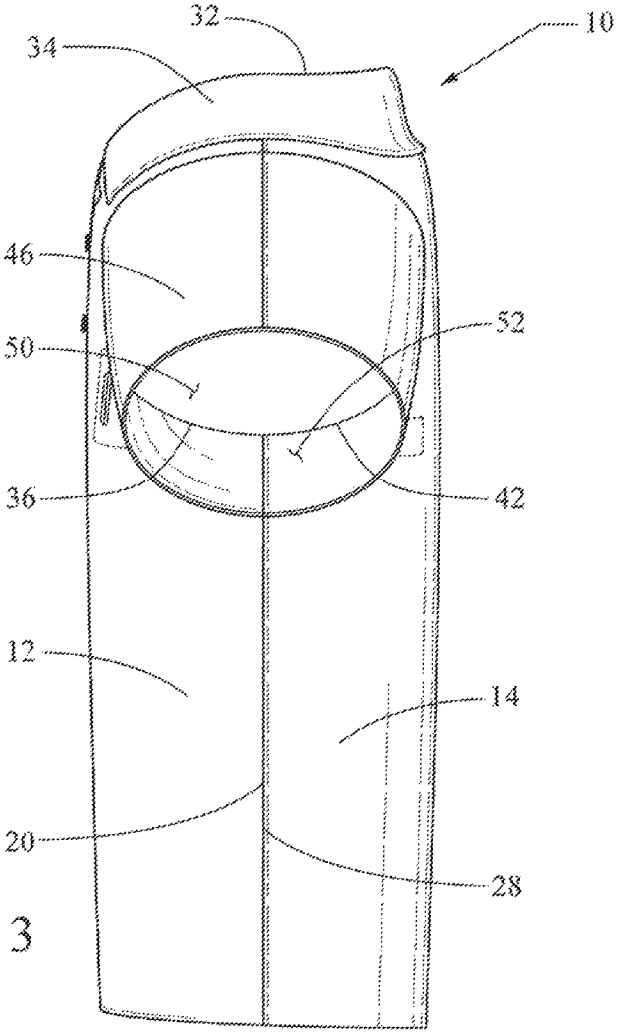
FIG. 3 illustrates a side view of the shirt of FIGS. 1 and 2.

Referring to FIGS. 1, 2, and 3, a shirt 10 for improving a swinging motion of a user wearing the shirt 10 is shown. As shown in FIGS. 1 and 3, the shirt 10 has a front panel 12. As best shown in FIGS. 2 and 3, the shirt also has a back panel 14. The front panel 12 has a top edge 15, a bottom edge 16, and generally opposing side edges 18 and 20. The rear panel 14 is similar to the front panel 12, in that the rear panel 14 also has a top edge 22, a bottom edge 24, and generally opposing side edges 26 and 28. The top edge 15 of the front panel 12 has a neck cutout 30. Similarly, the top edge 22 of the back panel 14 also has a neck cutout 32. It should be understood while the shirt 10 may be made of separate panels of cloth or other suitable materials; it is possible that the shirt 10 can be made of panels from a single unitary piece of material, such as a seamless design. For example, the front panel 12 and rear panel 14 may be made of a single continuous piece of material, without any seams between the front panel 12 and the rear panel 14.

The top edge 15 of the front panel is adjoined to the top edge 22 of the rear panel 14. Generally, the neck cutouts 30 and 32 are not adjoined to each other, so as to generally define an opening along the top edges 15 and 22 of the shirt 10, thereby allowing a neck of a user to protrude through the opening. Additionally, the shirt 10 may include a collar 34 adjacent to the neck cutouts 30 and 32.

The front panel 12 also has sleeve cutouts 36 and 38 located adjacent to the side edges 20 and 18 of the front panel 12 of the shirt 10. Similarly, the back panel 14 also has sleeve cutouts 40 and 42 located on the side edges 26 and 28 of the back panel 14 of the shirt 10.

The side edge 20 of the front panel 12 is adjoined to the side edge 28 of the back panel 14 of the shirt 10. However, the sleeve cutouts 36 and 42 are not adjoined, therefore defining an opening for a left arm of the user to protrude through. Similarly, the side edge 18 of the front panel 12 is adjoined to the side edge 26 of the back panel 14, except where the sleeve cutouts 38 and 42 are located, defining an opening. This allows the right arm of the user of the shirt 10 to protrude through this opening.

The shirt 10 also includes a tubular sleeve 46 that is adjoined to the sleeve cutouts 36 and 42. The shirt 10 may also include a second tubular sleeve 48 adjoined to the sleeve cutouts 38 and 40. The tubular sleeves 46 and 48 are in fluid communication with an interior space 50 of the shirt 10 that is located between the front panel 12 and the back panel 14.

As shown in FIG. 3, the interior space 50 is shown looking down the sleeve cutout 46 of the shirt 10. This interior space is located between the front panel 12 and the back panel 14 of the shirt 10 and is in fluid communication with an inside area 52 of the sleeve cutout 46.

Figure 4:
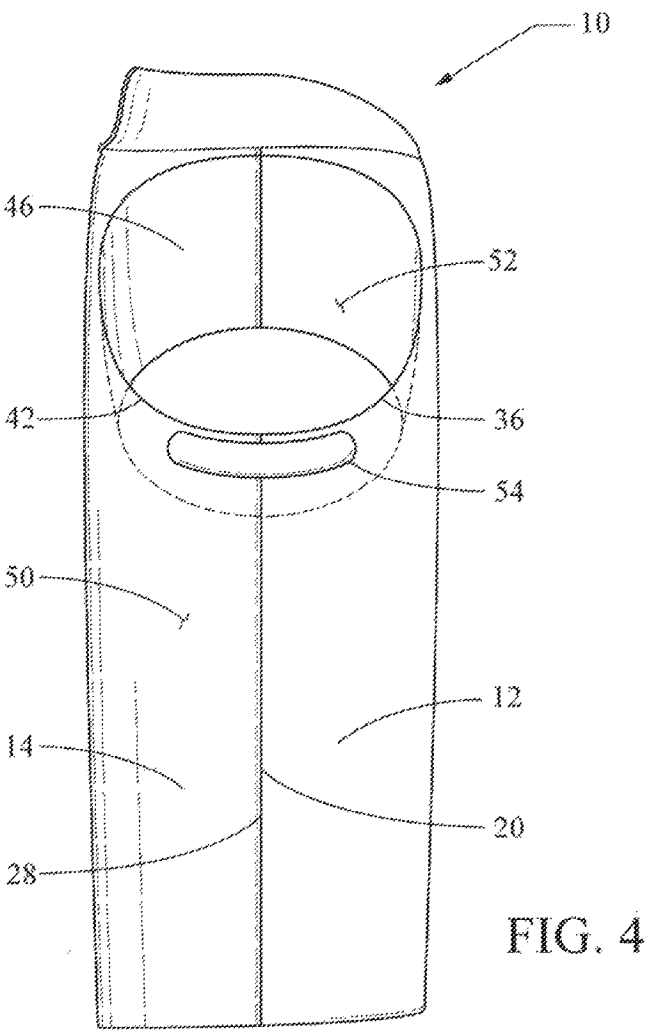
FIG. 4 illustrates an interior view of the shirt of FIGS. 1-3, generally taken along lines 4-4 of FIG. 1.

As can be generally seen in FIGS. 1 and 2, the shirt 10, essentially has two halves—a left half 11 and a right half 13, generally divided by lines 4-4. Referring to FIG. 4, this figure illustrates a cutaway view generally taking along lines 4-4 of FIG. 1. Generally, this view may be equally applicable in the opposite direction, as the shirt 10 is generally a mirror image along lines 4-4 of FIG. 1. Therefore, elements discussed in the following paragraphs may be applicable to both halves 11 and 13 of the shirt 10, but may be only incorporated on one or both halves 11 and 13 of the shirt 10.

Still referring to FIG. 4, it can be better seen that the inside area 52 of the tubular sleeve 46 is in fluid communication with interior space 50 of the shirt 10. Additionally, a member 54 is located substantially adjacent to the sleeve cutouts 36 and 42 and also the side edges 20 and 28 of the front panel 12 and rear panel 14.

Figure 7A:
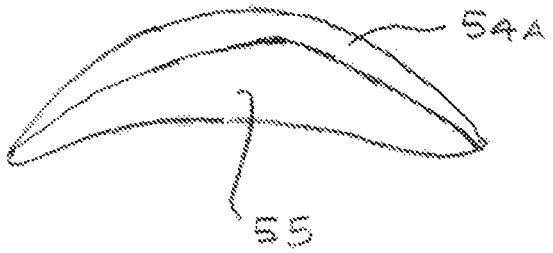
FIGS. 7*a* and 7*b* illustrate different embodiments of a member.
Figure 7B:
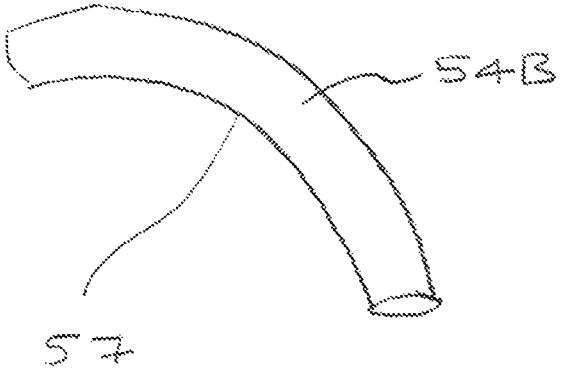

Referring to FIG. 7*a*, one embodiment of the member 54*a* is shown. In this embodiment, the member 54*a* generally has a curvature along the length of the member 54*a*. On the outside curve of the curvature 54*a*, the member 54*a* is substantially rounded. However, on the inside curvature 55 of the member 54*a*, the surface is generally flat along the length of the curve defining the curvature of the member 54*a*. Referring to FIG. 7*b*, a different embodiment of the member 54*b* is shown. In this embodiment, the inside curvature 57 is generally rounded, which differs from that shown in FIG. 7, where the inside is substantially flat along the curve.

The member 54 may also include one or more sensors that can measure body vitals. These sensors can include sensors that are designs to measure, body or skin temperature, heart rate, oxygen saturation, or other vital signs. Additionally, the member 54 may include sensors to measure pressure or movement. For example, the member 54 could include one or more sensors, such as accelerometers or gyroscopes that measure if a swing has occurred. Based on the swing occurring, audio or tactile feedback could be given to the user if the swing was properly made, such as being followed through or if a full swing has occurred, such as mentioned in U.S. Patent Publication 2009/0258719 (U.S. patent application Ser. No. 12/269,158), which is herein incorporated by reference in its entirety.

The member 54 could also track the number of swings taken or the velocity of the swings taken. Data, such as shots taken or other related data, could be stored in the member and then later downloaded either by a wired or wireless connection to a secondary device, such as a mobile phone or general purpose computer.

Further, it should be understood that the member 54 may be made out of a number of different materials that may be flexible in nature, such as foam or may be a flexible capsule filled in part with a flexible material. Additionally, the flexible member 54 may be an inflatable system, wherein the flexible member 54 inflates to a specified shape.

However, the member 54 may also be made of a non-flexible material, entirely or in additional to a non-flexible material. Such materials may include plastic, wood, cork, wire mesh, tin or any other type of solid material. Further, the member 54 may be an oversized golf tee or pencil or any other suitable device. The member 54 may be a non-flexible material wrapped with a flexible material.

Further, the member 54 may be an electronic device that emits a beep (audible), light (visual), or vibration (tactile) when in contact or not in contact with the user of the shirt 10. For example, the member 54 may be a pen-like shaped device that lights, vibrates, and/or beeps.

Figure 8:
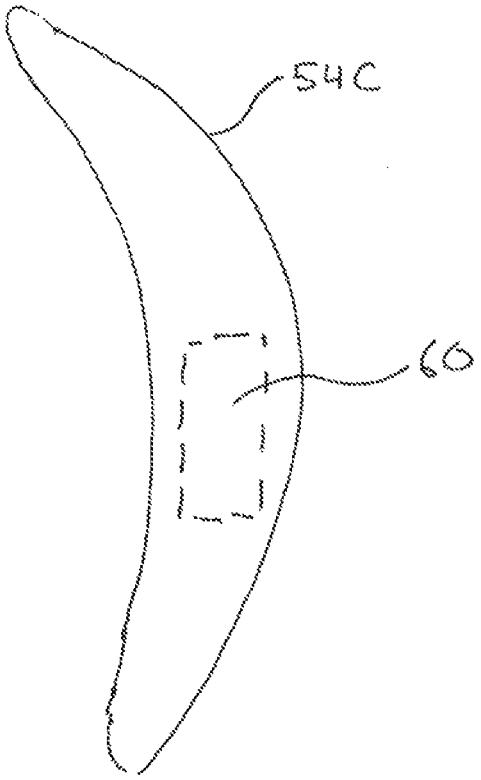
FIG. 8 illustrate a different embodiment of a member having an electronic system.

Referring to FIG. 8, another embodiment of the member 54C is shown. The general shape of the member 54C can take any one of a number of different shapes, such as those described above with regard to members 54A and 54B. However, in this embodiment, member 54C contains an electronic system 60, which is shown in greater detail in FIG. 9.

Figure 9:
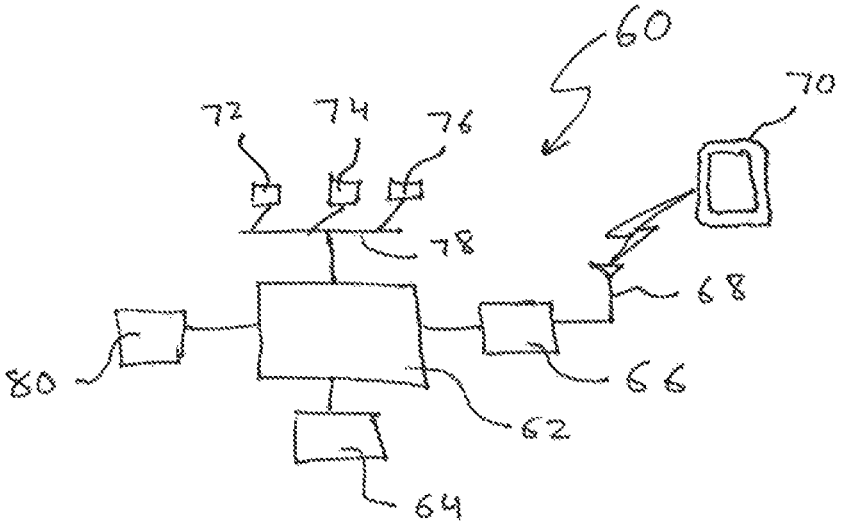
FIG. 9 illustrates a block diagram of the electronic system in the member of FIG. 8.

Referring to FIG. 9, the system 60 includes a processor 62. The processor 62 may be a single standalone processor or may be a plurality of processors acting in concert. The processor 62 may be in communication with a memory device 64 that is capable of storing instructions and or logging data for configuring the processor to perform any one of a number of tasks described in this specification.

The processor 62 may also be in communication with a network access device 66. The network access device 66 may be in communication with an antenna 68. When configured thusly, the network access device 66 allows the processor 32 to communicate with a third party device 70 via the antenna 68. Essentially, the network access device 66 may be a BlueTooth or Wi-Fi type device that allows communication with the mobile device 70 via the antenna 68. The third party device 70 may be any one of a number of different devices, such as a mobile phone or tablet device. Examples of these devices could include an iPhone from Apple, Inc. or a Galaxy S4 from Samsung Electronics, Inc.

The processor 62 may also be connected to a variety of sensors 72, 74, and 76. These sensors may be any one of a number of different sensors or may just be a single sensor. For example, the sensor 72 may be an accelerometer to measure the movement of the member 54C. This could be helpful in determining the swing motion of the user of the member 54C. Sensor 74 could be a pressure sensor so as to be able to determine if the user of the member 54C is squeezing the member 54C so as to maximize their swing motion. This "squeeze factor" can be important when determining if the user of the member 54C is appropriately swinging. The sensor 76 may be a type of sensor that is configured to measure body vitals, such as heart rate or other vital signals.

The sensors 72, 74, and 76 may be in communication with the processor directly or via a bus 78. As such, the processor 62 can record data received from the sensors 72, 74, and 76 and store this data in the memory 64. Information stored in the memory 64 can then be transmitted to the mobile device 70 via the network access device 66.

The system 60 may also have a physical feedback device 80. The physical feedback device 80 may be a small vibration device or could be an audible device. Essentially, based on information received from the sensor 72, 74, and 76, the processor 62 can be configured to provide some form of feedback via the feedback device 80 to the user of the member 54C.

By providing feedback to the user of the member 54C via the feedback device 80 or via the mobile device 70, the user of the member 54C will, over time, develop better sensory systems so as to approve the swinging motion. This improvement in the swinging motion may start slowly at first, but with additional feedback, the user of the device 54C will develop better sensory systems and control of their swinging motion, eventually resulting in a much better swing.

Referring back to FIG. 4, the member 54 may be permanently attached to the shirt 10 through the use of any number of adhesives. Additionally, the flexible member may be attached to the shirt 10 by stitching the member 54 to the shirt 10. Further, the member 54 may be attached to the shirt 10 through the use of a removable attachment system, such as a hook and loop fastener.

Figure 5:
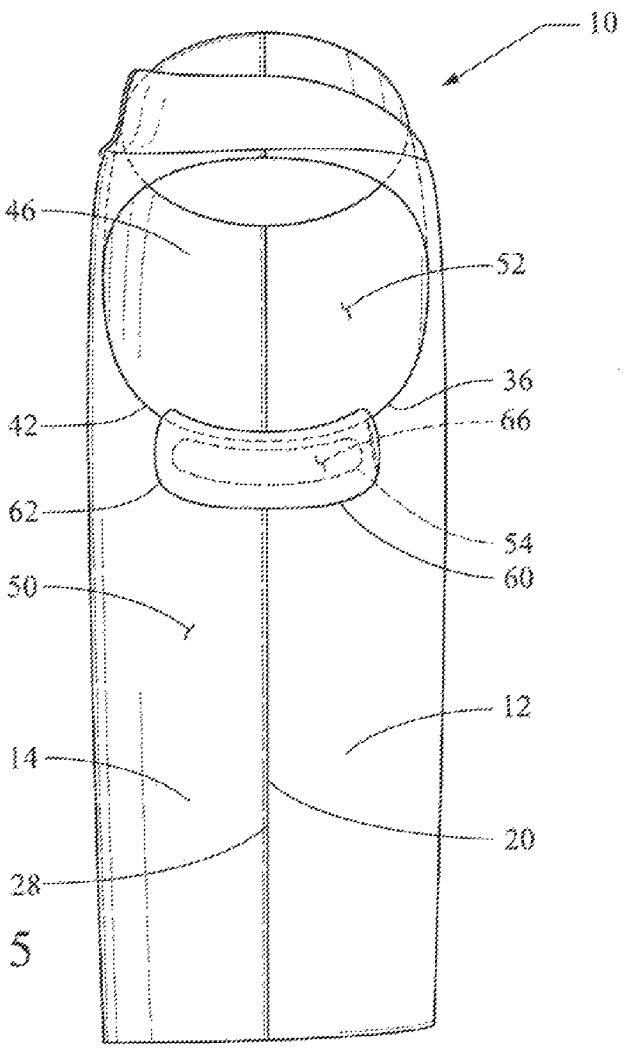
FIG. 5 illustrates another view of the interior section of the shirt of FIG. 4.

Referring to FIG. 5, another embodiment of attaching the flexible member 54 to the shirt 10 is shown. In this embodiment, a pouch 60 having edges 62 is shown. The edges 62 of the pouch 60 may be attached to the sleeve 46, the rear panel 14, and the front panel 12, generally in an area where the sleeve cutouts 36 and 42 meet with the edges 20 and 28 of the front and rear panels 12 and 14, respectively. By so doing, the member 54 may be encapsulated by the pouch 60 and portions of the sleeve 46, front panel 12, and rear panel 14.

Referring to FIGS. 1 and 5, the front panel of the shirt 10 may have an opening 64 in fluid communication with the space 66 defined between the pouch 60 and the tubular sleeve 46, front panel 12, and rear panel 14. The opening 64 allows for quick and easy insertion or removal of the member 54, thereby providing the golfer with the benefit of wearing a shirt that is indeed 'convertible'. By allowing the easy removability or insertability of the member 54 via the opening 64, the golfer is given choices. He can for example choose to use shirt 10, with member 54 inserted, as a 'training shirt' when he is on the practice range. Then without having to change into a different shirt, the golfer can then easily and quickly remove member 54 via opening 64, and continue to wear the same shirt 10 as his 'regular golf shirt' as he begins an official round of play (possibly a requirement in case golf rules dictate that the use of such a member 54 would violate golf rules). Additionally, the easy removability or insertability of the member 54 via the opening 64 allows the user of the shirt 10 to easily and temporarily practice swinging without the use of the member 54, eventually allowing the golfer to groove and habituate his swing path without the use of member 54

Additionally, the front panel 12 of the shirt 10 may also include a series of design lines 68*a* and 68*b* that extend substantially from the top edge 15 of the front panel 12 towards the bottom edge 16 of the front panel 12. Referring to FIG. 2, the rear panel 14 of the shirt 10 may also have design lines 68*c* and 68*d* extending from the top edge 22 of the rear panel 14 of the shirt 10 to the bottom edge 24 of the rear panel 14 of the shirt 10.

The design lines 68*a* and 68*b* also provide a function in that they add a benefit to the inventive golf shirt 10. As the golfer wearing the shirt 10 addresses the ball, the design lines 68*a* and 68*b* guide/map/cue the golfer's position, signaling for him an awareness of the triangular hanging/shaping of the arms. For example, the design line 68*b* becomes another visual point of awareness as the golfer is cued/mapped/guided into a full backswing turn with the shoulder meeting the golfer's chin. The design line 68*a* becomes another point of awareness as the golfer is visually cued/guided/mapped into a full finishing 'swing-through'.

Figure 6:
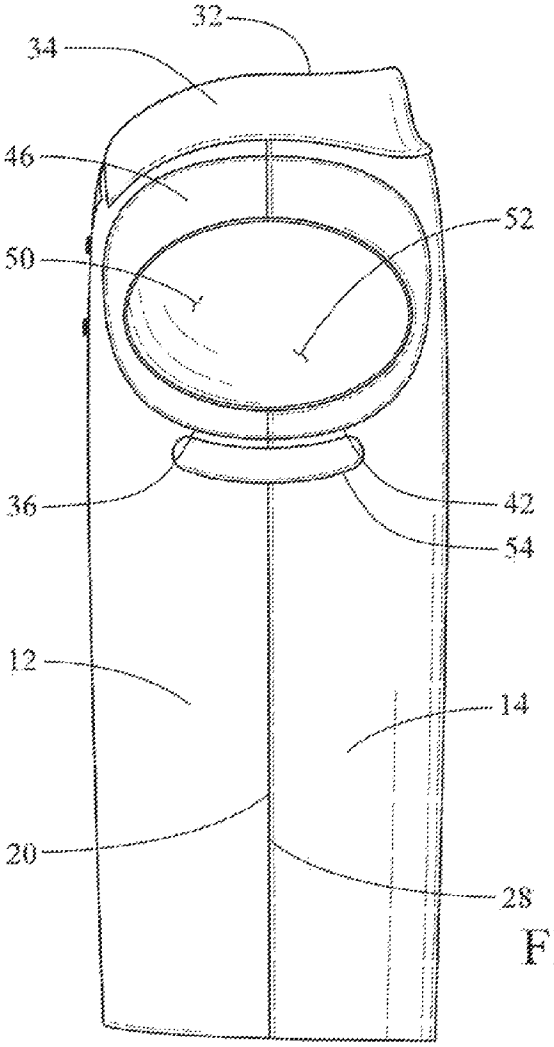
FIG. 6 illustrates another side view of the shirt of FIG. 1 having a member located on the outside of the shirt.

Referring to FIG. 6, another embodiment of the shirt 10 is shown. In this embodiment, the member 54 is on the outside of the shirt 10 and not with the interior space 50 of the shirt 10. The member 54 is located substantially adjacent to the sleeve cutouts 36 and 42 and also the side edges 20 and 28 of the front panel 12 and rear panel 14, respectively.

Figure 10:
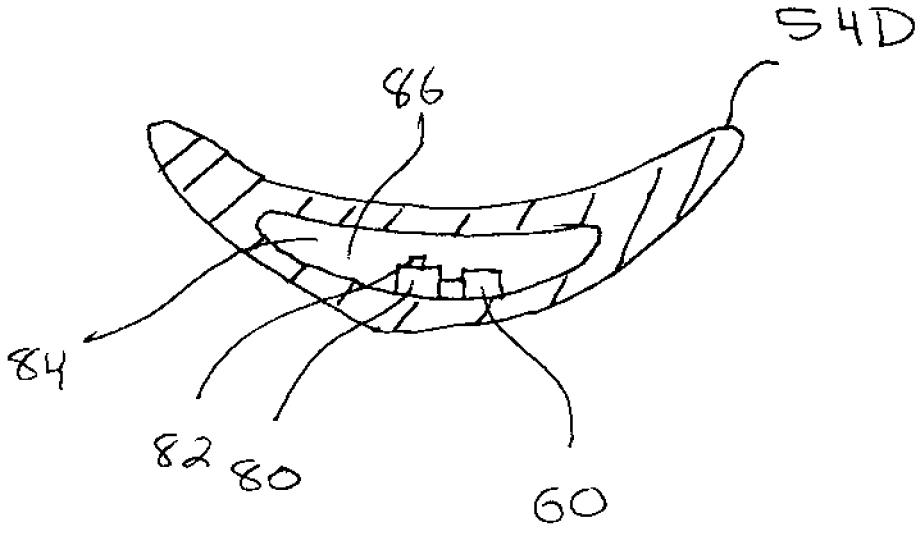
FIG. 10 illustrate a different embodiment of the member having an electronic system and a pressure sensor.

Referring to FIG. 10, another embodiment of the member 54D is shown. In this embodiment, the member 54D includes a fully encapsulated chamber 84. Located within the chamber 84 is a sensor 80 and the system 60. The sensor 80 may be a pressure sensor having a pressure diaphragm 82. As stated before, the chamber 84 is sealed. Within the chamber 84 is either a gas or fluid 86. As external pressure is applied to the member 54D, the size and shape of the chamber 84 can change. If pressure is increased, the exterior of the member 54D will put pressure on the fluid or gas 86, which will in turn put pressure on the diaphragm 82. The sensor 80 measures this displacement and provides a signal to the system 60. The system 60 can then store and/or transmit this information to an external device, such as a personal computer, smart watch, or tablet device, etc. An example of a system employing such a sensor is shown and described in U.S. Patent Application No. 2011/0098613, which is herein incorporated by reference in its entirety.

The pressure sensor of FIG. 10 allows the sensor 80 to measure pressure in the system 60 to generate a pressure profile. The pressure profile generated can be the amount of pressure that the user applies to the member 54D (or any of the other embodiments) over a period of time. This period of time would generally be measured over the time for the duration of the swing.

This pressure profile or other data collected by the system 60 from the sensor 80 in this embodiment or any of the other embodiments may also be shared with others. For example, the data collected by the sensor and interpreted by the system 60 may be transmitted to the external device such as a personal computer, smart watch, or tablet device, etc. From there, this data may be shared socially so that other users of similar devices may compare pressure profile and other data. By so doing, this essentially creates a fun and social competition between different users to compare pressure profiles and other data collected by the system 60. This competitive atmosphere would undoubtably motivate users to further refine their swing.

Figure 11:
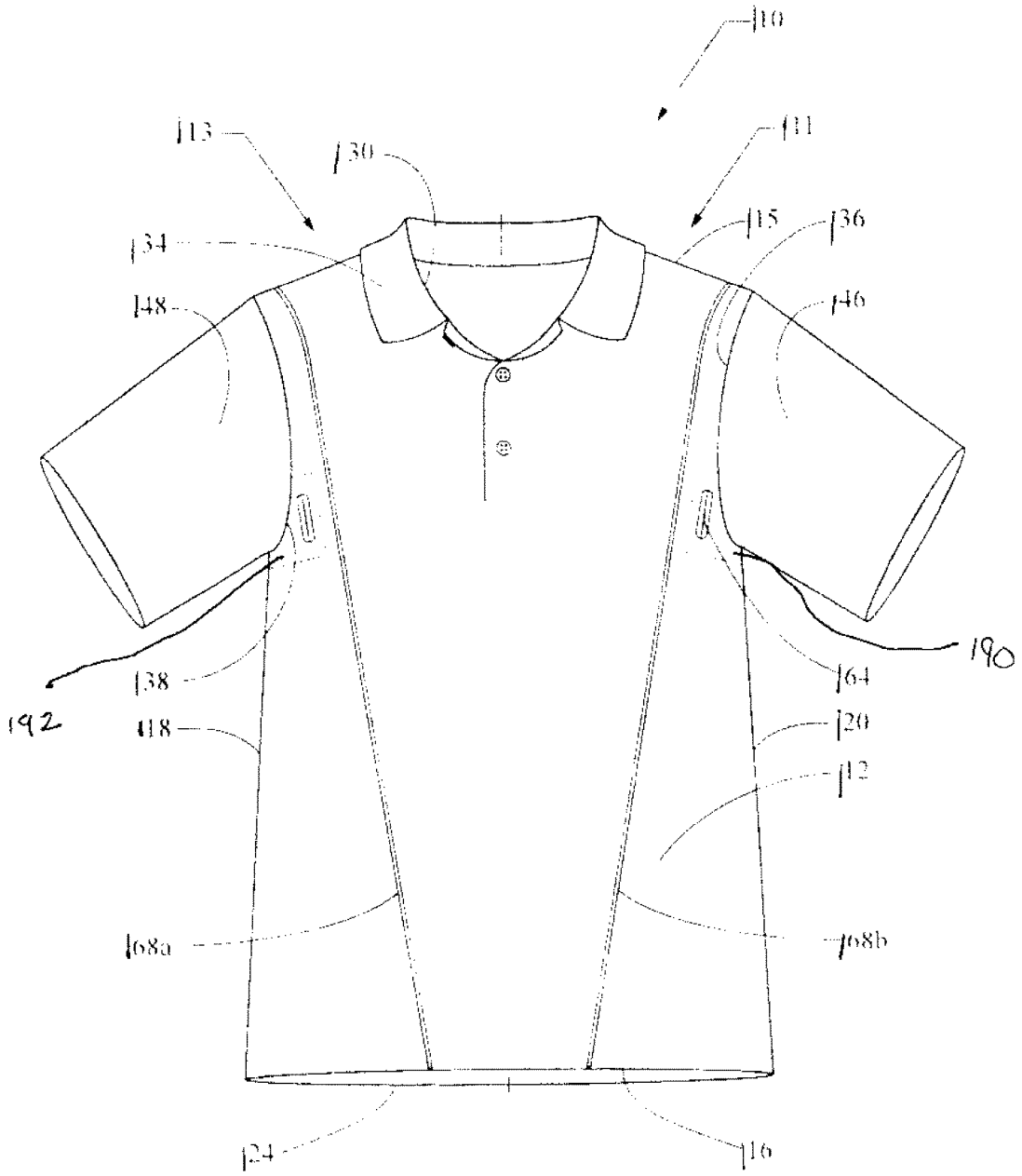
FIG. 11 illustrates a front view of a shirt for improving a swinging motion of the user wearing the shirt, the shirt utilizing conductive threads to measure pressure.

Referring to FIG. 11, another embodiment of the shirt 110 is shown. Like reference numerals have been utilized to refer to like elements, with the exception that the reference numerals have been increased by 100. Here, the shirt 110 includes areas having conductive threads 190 and 192. The conductive threads 190 and 192 are woven into the material of the shirt 110. Generally, these conductive threads 190 and 192 are located near the tubular slaves 146 and 148, near seems 136 and 138. The purpose of the conductive threads 190 and 192 are to determine pressure in the region where the conductive threads 190 and 192 are located. Further, while the conductive threads 190 and 192 function to measure pressure, and external member, such as the members described in FIG. 9 and elsewhere may be utilized. Here, any member utilized would not need the pressure sensor described as such a sensor is always ready located in the conductive threads 190 and 192. The purpose of the member would be to receive signals generated by the conductive threads 190 and 192 and transmit the signals to an external device, such as a smart phone, tablet, personal computer, smart watch, etc. An example of conductive threads being used as pressure sensors are shown in U.S. Pat. No. 7,770,473, which is herein incorporated by reference in its entirety.

As stated before, the elements mentioned in the previous paragraph may be incorporated on just one side of the shirt 10 or may be incorporated on both sides of the shirt 10. For example, FIGS. 4-6 show the member 54 located under the left side 11 of the shirt 10. However, alternatively or additionally, the member 54 may be located on the right side 13 of the shirt 10.

In sports such as golf, baseball, and tennis, the user seeks the development of an effective swing—an athletic swing that will prove successful in getting the club, bat or racquet to strike the ball with accuracy, power, and consistency. In attempting to deliver an effective athletic swing, it is advantageous if the arms of the athlete retain their connection to the body—up against, or in close proximity to the rib cage.

The benefit of the shirt 10 is that it helps the user to position and guide his arms and shoulders in the course of the swing. Rather than trying hard to remember and apply a long list of detailed instructions on how exactly to position oneself and on how to properly keep the upper arms connected to the body throughout the swing, the attached placement of the member 54 provides the user with a secured 'sensory guide' that does not drop to the ground or slide out of place as the golfer positions himself at address, and directs the turning and swinging of his shoulders and arms. As the 'body-mapping' inventive apparel organizes the muscles and provides the player with heightened sensory awareness, it allows him to swing basically by feel as opposed to becoming overly engaged in swing thoughts.

As a person skilled in the art will readily appreciate, the above description is meant as an illustration of implementation of the principles this invention. This description is not intended to limit the scope or application of this invention in that the invention is susceptible to modification, variation and change, without departing from the spirit of this invention, as defined in the following claims.

The invention claimed is:

1. A shirt for improving a swinging motion of a user wearing the shirt, the shirt comprising:

front and rear panels each having corresponding top, bottom and generally opposing side edges, wherein the front and rear panels are adjoined to each other by the top and side edges, defining an interior space of the shirt;

said front and rear panels including sleeve cutouts formed on each side edge adjacent the top edge, and a neck cutout formed on the top edges of the front and rear panels;

at least one tubular sleeve permanently joined to the front and rear panels of at least one of the sleeve cutouts, the tubular sleeve defining an inside area, the inside area being fluidly connected to the interior space of the shirt;

a member substantially adjacent to the sleeve cutout and the side edges of both the front and rear panels, wherein the member is removably attached or permanently attached to the shirt; and the member further comprising a processor, a network access device and at least one sensor, wherein the processor is in communication with the network access device and the at least one sensor, the processor being configured to determine at least one characteristic of the swinging motion of the user based on information received from the at least one sensor; and wherein the member further comprises an encapsulated interior, and a pressure sensor for measuring the pressure inside the encapsulated interior.

2. The shirt of claim 1, wherein the encapsulated interior contains a medium.

3. The shirt of claim 2, wherein the medium is a gas or liquid.

4. The shirt of claim 1, wherein the member is a flexible member.

5. The shirt of claim 1, wherein the member has a curvature corresponding the edges of at least one of the sleeve cutouts.

6. The shirt of claim 1, wherein the member is located entirely within the inside area of the at least one tubular sleeve or the interior area of the shirt.

7. The shirt of claim 1, wherein the member is located in an outside area of the at least one tubular sleeve.

8. The shirt of claim 1, wherein the member is permanently coupled adjacent to the sleeve cutout and the side edges of both the front and rear panels.

9. The shirt of claim 1, wherein the member is removably coupled to the sleeve cutout and the side edges of both the front and rear panels.

10. The shirt of claim 7, wherein the member is removably coupled to the sleeve cutout and the side edges of both the front and rear panels via hook-and-loop fasteners.

11. The shirt of claim 7, further comprising a pouch, the pouch being permanently coupled to the shirt, the pouch being in fluid communication with an opening configured to receive the member for allowing the member to be easily inserted or removed from the pouch.

12. The system of claim 1, wherein the member emits a visual, audible or tactile output.

13. A shirt for improving a swinging motion of a user wearing the shirt, the shirt comprising:

front and rear panels each having corresponding top, bottom and generally opposing side edges, wherein the front and rear panels are adjoined to each other by the top and side edges, defining an interior space of the shirt;

said front and rear panels including sleeve cutouts formed on each side edge adjacent the top edge, and a neck cutout formed on the top edges of the front and rear panels;

at least one tubular sleeve permanently joined to the front and rear panels of at least one of the sleeve cutouts; and conductive threads having a pressure sensitive layer having a pressure-dependent electric characteristic, the conductive threads being located on, within or forming at least one of the front panel, rear panel or the at least one tubular sleeve.

14. The shirt of claim 13, further comprising a processor and a network access device, wherein the processor is in communication with the network access device and the conductive threads, the processor being configured to determine at least one characteristic of the swinging motion of the user based on information received from the conductive threads.

15. The shirt of claim 14, further comprising a pouch, the pouch being permanently coupled to the shirt, the pouch configured to receive the processor and the network access device for allowing the processor and the network access device to be easily inserted or removed from the pouch.

16. The system of claim 14, wherein the processor is configured to transmit at least one characteristic of the swinging motion of the user to an external device via the network access device.

17. The shirt of claim 13, wherein the conductive threads are located in an outside area of the at least one tubular sleeve.

* * * * *